United States Patent [19]

Plinke et al.

[11] 4,262,162

[45] Apr. 14, 1981

[54] COMPOSITE CORRUGATED ELECTRICAL CABLES

[75] Inventors: Wolfgang G. Plinke, Hanover, Fed. Rep. of Germany; Dimitri R. Stein, Larchmont; Gerhard Stoeckl, Rye, both of N.Y.

[73] Assignee: Kabel-und Metallwerke Gutehoffnungshuette AG, Fed. Rep. of Germany

[21] Appl. No.: 52,555

[22] Filed: Jun. 27, 1979

[30] Foreign Application Priority Data

Jul. 14, 1978 [DE] Fed. Rep. of Germany ..... 2830984

[51] Int. Cl.[3] ..... H01B 7/34; H01B 7/28

[52] U.S. Cl. ..... 174/15 C

[58] Field of Search ..... 174/15 C, 15 S, 102 D, 174/106 D, 105 R, 16 B, 12 R, 28, 27, 126 S, 128 S; 138/111, 114, 121, 122

[56] References Cited

U.S. PATENT DOCUMENTS 3,340,353 9/1967 Mildner ..... 174/105 R 3,717,718 2/1973 Schmidtchen ..... 174/106 D 3,866,670 2/1975 Cramer et al. ..... 138/111 X

*Primary Examiner*—Arthur T. Grimley

*Attorney, Agent, or Firm*—James C. Jangarathis

[57] ABSTRACT

A composite corrugated electrical cable is provided in accordance with the teachings of the instant invention wherein a plurality of corrugated tubular conductors are concentrically positioned with respect to each other, each of such tubular conductors having corrugations that differ from those of the immediately adjacent tubular conductors in wave pitch, shape, depth or longitudinal separation. The corrugation arrangements permit differential longitudinal displacement between adjacent tubular conductors for achieving a composite cable of high flexibility. Further, various corrugation protrusions engage the adjacent tubular conductors to provide radial spacial separations between the adjacent tubular conductors thus providing an intermediate path through which a cooling medium may be passed for increasing the heat dissipation and the power capacity of the electrical cable.

2 Claims, 1 Drawing Figure

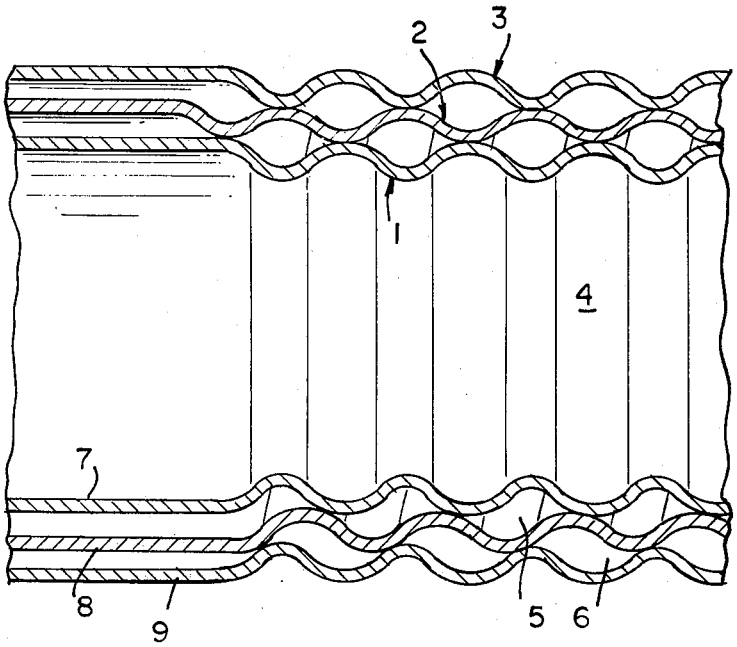
2
3
1
4
7
8
9
5
6

COMPOSITE CORRUGATED ELECTRICAL CABLES

This invention relates to a composite corrugated electrical cable (for example, a high voltage transmission cable) which includes a plurality of corrugated tubular conductors concentrically positioned with respect to each other, the corrugations of such tubular conductors being so configured as to permit differential longitudinal displacement of adjacent tubular conductors for acquiring enhanced cable flexibility. Spacial radial separations are maintained between adjacent tubular conductors of the composite as a result of various protrusions of the corrugations engaging the immediately adjacent surface of the adjacent tubular conductor, thus providing intermediate paths through which a cooling medium may be passed for increasing heat dissipation and the power transmission capacity of the electrical cable.

In the employment of electrical cable, or for example, the high voltage type known to the prior art, an increased power transmission rating is usually acquired by increasing the diameter of the outer coaxial conductor or sheath to increase the distance between the outer and inner conductor, thus minimizing the risk of insulation breakdown or sparkover. Such electrical cables may comprise insulation materials in the form of solids, liquids or gas; for example, they may include oil dielectrics, extruded polyethylene, or a suitable high voltage resistance gas such as $SF_6$.

Electrical transmission cables of the high voltage type, generally comprise an inner elongated conductor and a concentrically related tubular outer conductor, with a gaseous insulating environment therebetween. Though the magnitude of the diameter of the outer tubular conductor of such electrical cables has a direct relationship with increased capacity for energy transmission, it has an inverse relationship as to flexibility with regard to such prior art electrical cables. It has been found that high flexibility is a preferred and sometimes determinative factor in the operational acceptance of high voltage transmission cables. Under operational conditions high voltage transmission cables may experience substantial longitudinal expansion because of the high temperature conditions ressulting within the electrical cable. The gas insulated high voltage transmission cables known to the prior art usually have their central conductors maintained in position by plastic spacer elements extending between the inner and outer conductors at various points along the longitudinal length of the transmission cable. Such spacers are subjected to stresses resulting from the longitudinal expansion of such electrical cables, and are often deformed as a result of flexibility restraints and/or excessive high temperature conditions within the known prior art electrical cables.

It is a principle object of the present invention to provide a composite corrugated electrical cable which has a high degree of flexibility, notwithstanding a large cross-sectional diameter. Another object of the present invention is the provision of spacial radial separations between concentrically related adjacent tubular conductors of the electrical cable for providing intermediate paths through which a cooling medium may be passed for increasing power transfer capacity because of increased heat dissipation.

In accordance with the teachings of the present invention, a composite corrugated electrical cable is provided wherein a plurality of corrugated tubular conductors are concentrically positioned with respect to each other. Each of such tubular conductors has corrugations that differ from those of the immediately adjacent tubular conductor in wave pitch, shape, depth or longitudinal separation. This relationship between the corrugations avoids a restraint to differential longitudinal movement of adjacent tubular conductors, thus permitting a differential longitudinal displacement between adjacent conductors for enhancing the flexibility of the composite cable. The resulting electrical cable is flexible to a high degree, notwithstanding its large cross-sectional diameter. Additionally, such relationship between the corrugations provides spacial radial separations between adjacent concentric tubular conductors of the electrical cable that provide immediate paths between adjacent tubular conductors which may advantageously be employed for the passage of a cooling medium for increased heat dissipation.

In accordance with the concepts of the invention, a first tubular conductor may be helically corrugated while the immediately adjacent tubular conductor has parallel corrugations, that is, corrugated with a zero pitch. Alternatively, the tubular conductors may be helically corrugated in counter directions. If the outer tubular conductor has parallel corrugations the ability of attaching coupling devices is enhanced. Further, in those situations requiring a separate conductor path, the tubular conductors may be insulated one from the other by putting an insulation coating on one surface of each tubular conductor which is immediately adjacent to the corrugation protrusions of the adjacent tubular conductor. Alternatively, such separate conductive paths may be provided by wrapping insulation bands about each of the outer surfaces of each interior tubular conductor, or by providing a shrinkable plastic material about each such interior tubular conductor. Such insulation procedures have been found to also enhance the longitudinal slidability of the adjacent tubular conductors; i.e., improves the efficacy of permitting longitudinal displacement between adjacent tubular conductors.

As previously noted, the spacial radial separations between the tubular conductors along the longitudinal length of the composite cable provides an intermediate passage between which a cooling medium may be employed. This is especially advantageous in situations wherein heat dissipation due to energy losses is restrained because of insulation arrangements of the aforesaid types.

The manufacture of the composite corrugated electrical cable having structural characteristics in accordance with the instant invention, may employ priorly known methods of continuously shaping copper or aluminum strip into a tubular configuration, continuously welding the abutting side edges of the strip so formed, and then corrugating such welded tubular configuration. Consecutively, further tubular conductors may be formed concentrically about the priorly formed tubular conductors, welded and successively corrugated to form the composite corrugated arrangement of the electrical cable in accordance with the instant invention. Depending upon the desired electrical and mechanical characteristics of the electrical cable, it may be advantageous to have concentric tubular conductors of increasing thickness from the inner to the outermost tubular conductor.

The invention will be more clearly understood by reference to the following description of an exemplary embodiment thereof, in conjunction with the accompanying drawing which is a simplified side sectional view of a plurality of concentrically related corrugated tubular conductors of an electrical cable.

The drawing illustrates three concentrically related, tubular conductors, 1, 2 and 3, of suitable conductive material such as copper or aluminum. In this embodiment the tubular conductors 1, 2 and 3 have the same wall thickness; with the inner tubular conductor 1 and the outer tubular conductor 3, each having parallel corrugations, and the intermediary tubular conductor 2 having helical corrugations. Such corrugation relationship prevents longitudinal entanglements or anchoring of the adjacent tubular conductors as a result of differential longitudinal expansion caused, for example, as a result of differences in the high temperature conditions experienced by each of the tubular conductors. Rather than causing longitudinal entanglements or a longitudinal anchoring effect between adjacent tubular conductors 1 and 2, and 2 and 3, the described corrugation relationship permits a substantial differential longitudinal displacement between the immediately adjacent tubular conductors 1 and 2, and 2 and 3. At an end of the composite of tubular conductors 1, 2 and 3, an electrical connector or coupling device (not shown) may be positioned to make electrical contact to all three of such tubular conductors 1, 2 and 3, which is usually required when the tubular conductors are insulated from each other along their longitudinal lengths. The inner space 4 within the tubular conductor 1, and the intermediary spaces 5 and 6 between tubular conductors 1 and 2, and 2 and 3, respectively, may be utilized to admit a cooling medium for selectively increasing heat dissipation, thus increasing the power transmission capability of the electrical cable.

While the invention has been described in connection with an exemplary embodiment thereof, it will be understood that many modifications will be readily apparent to those of ordinary skill in the art, and that this invention is intended to cover adaptations or variations thereof. Therefore, it is manifestly intended that this invention be only limited by the claims and equivalence thereof.

I claim:

1. In a high voltage transmission cable of a type including an elongated inner current conductor, a composite inner tubular current conductor comprising:

a first corrugated tubular conductor; and a second corrugated tubular conductor positioned concentrically about said first tubular conductor, said second tubular conductor having corrugations that differ from those of said first tubular conductor in wave pitch, shape, depth or longitudinal separation, so as to permit longitudinal sliding movement between a plurality of engagements of various corrugation protrusions of one of said first and second tubular conductors with the immediately adjacent surface areas of the other of said first and second tubular conductors; whereby such permissible longitudinal sliding avoids internal longitudinal entanglements and anchoring between said tubular conductors upon differential longitudinal expansion of said first tubular conductor with respect to said second tubular conductor as a result of differences in high temperature operational conditions experienced by said tubular conductors, radial separation is maintained between said first and second tubular conductors as a result of said plurality of engagements, and high flexibility of the composite conductor is achieved notwithstanding a large aggregate current conducting cross-sectional area of said composite conductor.

2. A composite tubular current conductor in accordance with claim 1 comprising a third corrugated tubular conductor positioned concentrically about said second tubular conductor, said third tubular conductor having corrugations that differ from those of said second tubular conductor in wave pitch, shape, depth or position so as to permit longitudinal displacement between said second tubular conductor and said third tubular conductor while maintaining spacial radial separations between said second and third tubular conductors as a result of a plurality of engagements of various corrugation protrusions of one of said second and third tubular conductors with immediately adjacent surface areas of the other of said second and third tubular conductors.

* * * * *